United States Patent [19]

Watanabe et al.

[11] Patent Number: 4,489,551

[45] Date of Patent: Dec. 25, 1984

[54] FAILURE DETECTION SYSTEM FOR HYDRAULIC PUMP

[75] Inventors: Hiroshi Watanabe; Eiki Izumi, both of Ibaraki, Japan

[73] Assignee: Hitachi Construction Machinery Co., Ltd., Tokyo, Japan

[21] Appl. No.: 571,732

[22] Filed: Jan. 18, 1984

[30] Foreign Application Priority Data

Jan. 19, 1983 [JP] Japan ..... 58-5798
Nov. 15, 1983 [JP] Japan ..... 58-214775

[51] Int. Cl.[3] ..... F15B 21/02

[52] U.S. Cl. ..... 60/328; 60/329; 60/389; 60/390; 60/442; 417/217; 417/63

[58] Field of Search ..... 417/217–222, 417/63; 60/368, 445, 452, 389, 390, 442, 328, 329

[56] References Cited

U.S. PATENT DOCUMENTS

| | | | |
|---|---|---|---|
| 4,151,718 | 5/1979 | Gravely | 60/368 X |
| 4,321,016 | 3/1982 | Sakamoto et al. | 417/63 |
| 4,369,625 | 1/1983 | Izumi et al. | 60/368 X |
| 4,399,653 | 8/1983 | Pylat | 60/368 X |
| 4,412,500 | 11/1983 | Krautkremer | 60/390 X |

*Primary Examiner*—Edward K. Look
*Attorney, Agent, or Firm*—Antonelli, Terry & Wands

[57] ABSTRACT

A failure detection system for a hydraulic pump (1) having a displacement volume varying device (1*a*) and connected to at least one hydraulic actuator (4) to constitute a hydraulic circuit for driving the hydraulic actuator. The system includes means (*7a, 7b*) for sensing the discharge pressure of the pump, means (6) for detecting the value of shifting of the displacement volume varying device, means (5, 24) for closing the hydraulic circuit to block the flow of a hydraulic fluid through the circuit, starting means (9) for giving a command to start checking on the pump to see if it is normally functioning, and a control unit (2, 23, 28, 29) for performing checking on the pump to see if it is normally functioning. The control unit includes means (S-5, S-5') responsive to the command given by the starting means for giving a command to activate the closing means, data collecting means (S-11) for causing the displacement volume varying device to shift based on information ($P_a$, $P_b$ and Y) supplied by the pressure sensing means and shifting detecting means until the discharge pressure of the pump becomes at least substantially equal to a predetermined reference pressure ($P_r$) to collect data on the value of the shifting of the displacement volume varying device when the discharge pressure becomes substantially equal to the reference pressure, and failure judging means (S-12) for comparing the value collected by the data collecting means with a predetermined reference value of shifting ($Y_{ra}$ and $Y_{rb}$) to produce a failure signal when the collected value is greater than the reference value. The system further includes an indication device (10) responsive to the failure signal produced by the failure judging means for indicating that the hydraulic pump is not normally functioning.

10 Claims, 15 Drawing Figures

FAILURE DETECTION SYSTEM FOR HYDRAULIC PUMP

BACKGROUND OF THE INVENTION

1. Field of the Invention

This invention relates to failure detection systems for hydraulic pumps which are widely in use as a source of power for operating hydraulic excavators, hydraulic cranes and other hydraulic equipment and machinery, and more particularly it is concerned with a failure detection system for a hydraulic pump of the type described which is equipped with a displacement volume varying device and connected to at least one hydraulic actuator to constitute a hydraulic circuit for driving the hydraulic actuator.

2. Description of the Prior Art

A hydraulic pump which is used with a hydraulic excavator, a hydraulic crane and other hydraulic equipment and machinery constitutes the most important means for producing hydraulic energy, and a reduction in its performance due to failure or changes with time poses a serious obstacle to the operation of equipment and machine relying on the hydraulic pump for a supply of power. It is thus imperative that the operation of a hydraulic pump be checked to see if it is properly functioning. A failure detection system of the prior art conventionally used to check on the hydraulic pump to see if the pump shows any sign of failure or deterioration in performance (hereinafter inclusively referred to as failure) will be described.

Such failure detection system of the prior art comprises a hydraulic pressure tester connected to a discharge line of a variable displacement type hydraulic pump equipped with a displacement volume varying device (typical of which is a swash plate to which reference will hereinafter be made), and a regulator for actuating the swash plate in accordance with the discharge pressure of the hydraulic pump. The hydraulic pressure tester comprises a pressure gauge for measuring the hydraulic pressure, a flow meter for measuring the flow rate of a hydraulic fluid, and a manually operable variable restrictor for throttling the discharge of the pump to raise the discharge pressure. The variable displacement type hydraulic pump has connected thereto a revolution counter for measuring the number of revolutions thereof.

The operation of the failure detection system of the aforesaid construction will be described. A hydraulic fluid line which is connected to the discharge port of a variable displacement type hydraulic pump to be checked and constitutes part of a hydraulic circuit in which the pump is connected to at least one hydraulic actuator is cut off in a position close to the pump, and the hydraulic pressure tester is connected to the cut end of the line. Then, the pump is driven by an engine or other prime mover, and the number of revolutions N of the pump is measured by the revolution counter. While the pump is thus being driven, the variable restrictor of the tester is actuated to throttle the flow through the line until the hydraulic pressure indicated by the pressure gauge (the discharge pressure of the pump) becomes equal to a set pressure value $P_{ref}$. At this time, the flow rate of the discharged hydraulic fluid Q from the pump is measured by the flow meter. The flow rate of the discharged hydraulic fluid Q should vary depending on the magnitude of a shifting or tilting of the swash plate which is controlled by the regulator in accordance with the discharge pressure. Thereafter, a theoretical flow rate of the discharged hydraulic fluid $Q_{ref}$ from the pump is calculated based on the number of revolutions N and the set pressure value $P_{ref}$. Finally, the theoretical flow rate of the discharged hydraulic fluid $Q_{ref}$ is compared with the flow rate of the discharged hydraulic fluid Q measured previously, and the pump is diagnosed to be out of order when the result of the comparison exceeds an allowable value.

Some disadvantages are associated with the failure detection system of the prior art of the aforesaid construction and operation. For one thing, when a pump is checked, the hydraulic pressure tester must be connected to a portion of a hydraulic fluid line by cutting it off the rest of the line. This operation is time-consuming and has the risk of dust and other foreign matter being incorporated in the hydraulic fluid flowing through the line. For another thing, checking consists in actuating the variable restrictor and reading the pressure gauge and flow meter. This operation is also time-consuming and troublesome. Hydraulic machines and apparatus of a large size, such as a hydraulic excavator, are equipped with a multiplicity of hydraulic pumps. Thus, when the failure detection system of the aforesaid construction is used for checking the hydraulic pumps, difficulties have been experienced in quickly locating the failed pump.

SUMMARY OF THE INVENTION

This invention has been developed for the purpose of obviating the aforesaid disadvantages of the prior art. Accordingly, the invention has as its object the provision of a failure detection system for a hydraulic pump capable of automatically and quickly checking on the pump to see if it is normally functioning by eliminating the need to cut off a hydraulic fluid line and connect a hydraulic pressure tester thereto and capable of simultaneously checking on a multiplicity of hydraulic pumps to locate the pump which fails to normally function.

To accomplish the aforesaid object, the invention provides a failure detection system for a hydraulic pump having displacement volume varying means and connected to at least one hydraulic actuator to constitute a hydraulic circuit for driving said hydraulic actuator, such failure detection system comprising: (a) means for sensing the discharge pressure of said hydraulic pump, (b) means for detecting the value of shifting of said displacement volume varying means; (c) means for closing said hydraulic circuit to block the flow of a hydraulic fluid through the hydraulic circuit; (d) starting means for giving a command to start checking on the hydraulic pump to see if it is normally functioning; and (e) control means for performing checking on the hydraulic pump to see if it is normally functioning; (f) said control means including (i) means responsive to the command given by said starting means for giving a command to activate said closing means, (ii) data collecting means for causing said displacement volume varying means to shift based on information supplied by said pressure sensing means and shifting detecting means until the discharge pressure of the hydraulic pump becomes at least substantially equal to a predetermined reference pressure to collect the value of the shifting of said displacement volume varying means when the discharge pressure becomes substantially equal to the reference pressure, and (iii) failure judging means for comparing the value collected by said data collecting means with a predetermined reference value of shifting to produce a failure signal when the collected value is greater than the reference value; and (g) indication means responsive to the failure signal produced by said failure judging means for indicating that the hydraulic pump is not normally functioning.

DESCRIPTION OF THE PREFERRED EMBODIMENTS

Figure 1:
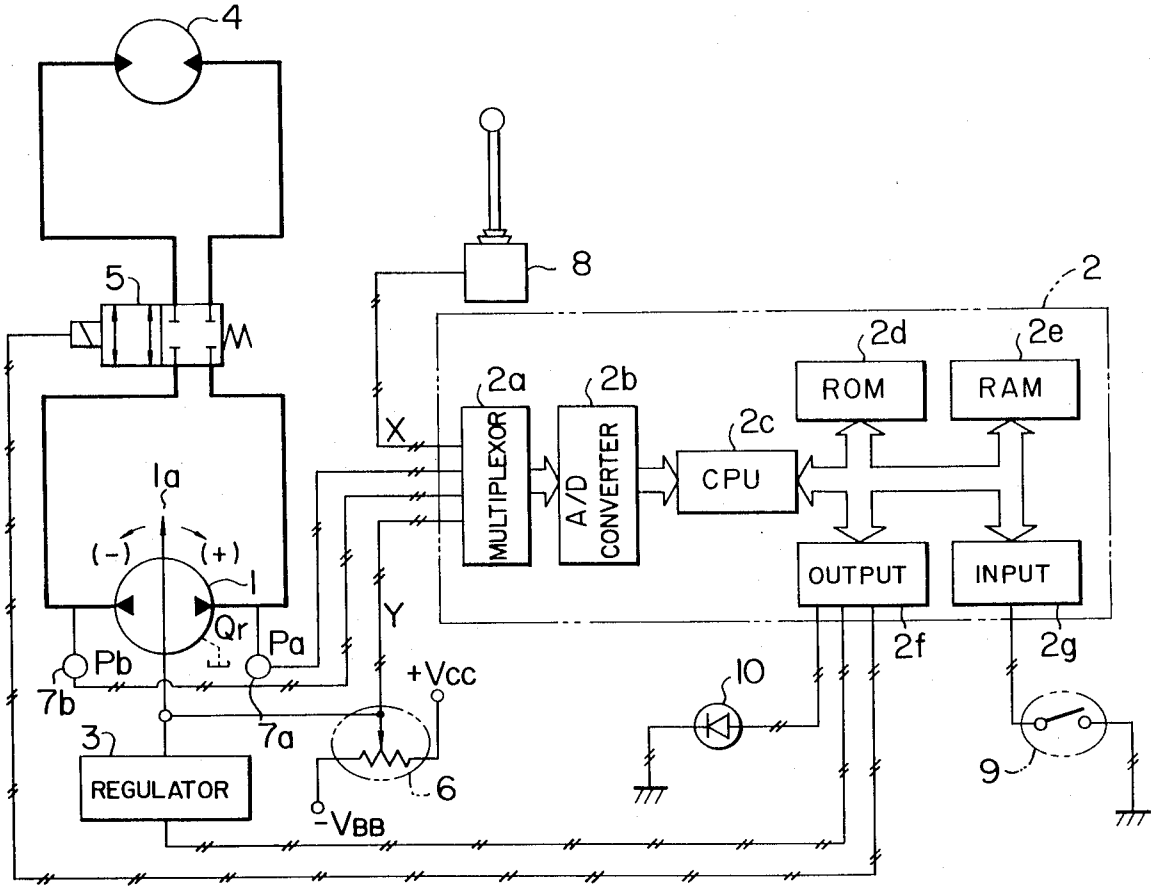
FIG. 1 is a block diagram of the failure detection system for a hydraulic pump comprising a first embodiment of the invention.

Referring to FIG. 1, the reference numeral 1 designates a variable displacement type hydraulic pump of the double-tilting type equipped with a displacement volume varying device 1*a* capable of tilting in both a plus (+) direction and a minus (−) direction. In the embodiment shown and described herein, the displacement volume varying device 1*a* is a swash plate which has the value of its shifting or tilting controlled by a regulator 3 operative in response to an electric signal from a control unit 2. The hydraulic pump 1 is connected to a hydraulic motor 4 to constitute a hydraulic circuit for driving the hydraulic motor 4.

Mounted between the hydraulic pump 3 and hydraulic motor 4 in the hydraulic circuit is an on-off control valve 5 which is switched from a closed position to an open position by an electric signal from the control unit 2. The control valve 5 constitutes means for closing the hydraulic circuit to block the flow of a hydraulic fluid through the hydraulic circuit.

A displacement detector 6 which comprises a potentiometer is operatively connected to the swash plate 1*a* to detect its tilting and produce a signal Y. Pressure sensors 7*a* and 7*b* are connected to line portions connected to a pair of ports of the hydraulic pump 1 to sense the discharge pressure thereof and produce signals Pa and Pb, respectively.

The value and direction of tilting of the swash plate 1*a* of the hydraulic pump 1 are indicated by an operation lever 8 which produces a signal X proportional to the manipulated variable to thereby control the operation of the hydraulic motor 4.

The control unit 2 which constitutes the essential part of the failure detection system for a hydraulic pump according to the invention is electrically connected to the operation lever 8, pressure sensors 7*a* and 7*b*, displacement detector 6, regulator 3 and control valve 5. The control unit 2 is also electrically connected to a start switch 9 for giving a command to initiate checking of the hydraulic pump 1 to see if it is normally operating, and an indicator 10 comprising a light emitting diode for indicating that the hydraulic pump 1 is not normally functioning. The control unit 2 is operative, when the start switch 9 is closed, to perform checking on the hydraulic pump 1 to see if it is normally functioning based on the signals X, Y and $P_a$ and $P_b$ from the operation lever 8, displacement detector 6 and pressure sensors $7_a$ and 7*b*, respectively.

In the embodiment shown and described herein, the control unit 2 is in the form of a microcomputer comprising a multiplexor 2*a* having the various signals inputted thereto by switching them, an A/D converter 2*b* for converting the analog signals inputted thereto into digital signals, a central processor unit (CPU) 2*c* for performing necessary calculation and operation based on the inputted signals, a read-only memory (ROM) 2*d* having stored therein the operation program of the CPU 2*c* and other data, a random-access memory (RAM) 2*e* for temporarily storing the input signals and the results of calculation, an output section 2*f* for outputting signals produced as the results of calculation to the regulator 3, valve 5 and indicator 10, and an input section 2*g* for inputting signals from the start switch 9 to decide whether or not the hydraulic pump 1 is to be checked to see if it is normally functioning.

The principle of operation of the embodiment shown in FIG. 1 of the failure detection system in conformity with the invention will be described by referring to FIG. 2 which is a graph showing the discharge pressure of the hydraulic pump 1 in which the abscissa represents the value of tilting (shifting) Y of the swash plate 1*a* and the ordinate indicates the discharge pressure $P_a$ ($P_b$) of the hydraulic pump 1. Assume that the valve 5 is closed and the hydraulic pump 1 is driven while the swash plate 1*a* is gradually tilted from a neutral position (in which the flow of the discharged fluid is zero) to a plus (+) or minus (−) direction. Then, the discharge pressure of the hydraulic pump rises after a certain value of tilting is passed and becomes constant when a relief pressure level set beforehand is reached. When the hydraulic pump 1 is operating normally, a value of tilting $Y_a$ of the swash plate 1*a* that would cause a predetermined discharge pressure $P_r$ (reference pressure) to be produced would be in a certain range. However, when the hydraulic pump 1 is not normally functioning or it has an internal leak $Q_r$ (see FIG. 1) which exceeds an allowance, for example, the value of tilting $Y_a$ of the swash plate 1*a* would become too great to remain in the aforesaid range.

Thus, in operation, the valve 5 is closed and the swash plate 1*a* is tilted gradually from the neutral position in any one direction or in the plus (+) direction, for example. When the value of the pressure sensor 7*a* reaches the reference pressure $P_r$ the value of tilting $Y_a$ of the swash plate 1*a* is read out of the displacement detector 6 and compared with a reference value of tilting $Y_{ra}$ set beforehand which is a value at least larger than the value of tilting which would cause the discharge pressure $P_r$ (reference pressure) to be produced when the hydraulic pump 1 is normally functioning. Thus, the value of tilting $Y_{ra}$ is a value based on which the hydraulic pump 1 is determined as to whether or not it is normally functioning. When the value of tilting $Y_a$ read out of the detector 6 is greater than the value of tilting $Y_{ra}$ as the result of the comparison, a failure signal is produced to activate the indicator 10 for indicating that the hydraulic pump 1 is not normally functioning. A similar operation is performed by tilting the swash plate 1*a* in the minus (−) direction. In this way, the hydraulic pump 1 can be checked to see if it is normally functioning.

The processes of operations for checking the hydraulic pump 1 to see if it has any failure as stored in ROM 2*d* of the control unit 2 of the embodiment shown and described hereinabove will be described in detail by referring to the flow charts shown in FIGS. 3–6.

The control unit 2 has inputted thereto through the multiplexor 2*a* one after another a lever command signal X produced by the operation lever 8, pressure signals $P_a$ and $P_b$ produced by the pressure sensors 7*a* and 7*b*, respectively, and a tilting signal Y produced by the displacement detector 6, which are temporarily stored in the RAM 2*e* through the A/D converter 2*b* (step S-1, with the following steps to be denoted with S-2, S-3 . . . ). Then, the start switch 9 is checked to see if it is on or off (S-2). When the hydraulic pump 1 is to be checked to see if it is normally functioning, the start switch 9 is turned on. When no checking is to be performed, it is turned off. When the start switch 9 is off, regular control operation is performed. More specifically, when the hydraulic motor 4 is to be driven for operation, a control signal for opening the valve 5 is produced through the output section 2*f*, and when its operation is to be interrupted, a control signal for closing the valve 5 is produced through the output section 2*f* (S-3). Then, the process shifts to a swash plate tilting routine (S-4), in which control is effected to make the value of tilting Y of the swash plate 1*a* coincide with the value of the lever command signal X. This control operation will be described by referring to the flow chart shown in FIG. 4.

Firstly, calculation is done on the difference ΔY between the value of the lever command signal X that is read and stored and the actual value of tilting Y of the swash plate 1*a* (S-4-1). Then, it is determined whether the difference ΔY is positive or negative and whether ΔY=0 (S-4-2). When the difference ΔY is positive (or when the value of tilting Y of the swash plate 1*a* is smaller than the value of the lever command signal X), a signal for tilting the swash plate 1*a* in the plus (+) direction is outputted through the output section 2*f* to the regulator 3 (S-4-3). When the difference ΔY is negative, a signal for tilting the swash plate 1*a* in the minus (−) direction is produced (S-4-5). When the difference ΔY is zero, a signal for stopping the tilting of the swash plate 1*a* is produced (S-4-4). In regular operation, the aforesaid process is repeated in the control unit 2, so as to drive the hydraulic motor 4 in accordance with the operation of the operation lever 8.

Let us describe the processes of operation to be performed when the start switch 9 is on and gives a command to start checking on the hydraulic pump 1 to see if it is normally functioning. In this case, the start switch 9 is confirmed to be on in step S-2, so that the process of operation shifts to step S-5 which represents brake means. In step S-5, an off signal for closing the valve 5 is outputted. Then, in step S-6, it is determined whether or not the process of operation shifted for the first time to the step for checking the pump after the start switch 9 is turned on. When it is determined that it is the first time, a tilting direction indicating flag which indicates the direction in which the swash plate 1*a* should be tilted for checking the pump 1 is set at the plus (+) direction in step S-7 which represents initial shifting direction deciding means. In steps S-8 and S-9 which represent pump control means, regardless of the condition of the operation lever 8, the value of a pump tilting command $X_L$ is neutralized (S-8), and the value of the lever command signal X is rewritten to have the value $X_L$ (S-9). Thereafter, the process of operation shifts to step S-4, so as to bring the swash plate 1*a* to the neutral position.

Here, the process of operation shifts again through steps S-1, S-2 and S-5 to step S-6. In step S-6, it is found that the process through the step S-5 is not followed for the first time, so that the process of operation shifts to S-10, in which it is checked whether or not the data collection terminating flag (subsequently to be described) indicating that data collection has terminated is set. Since data collection has not terminated yet, the process of operation shifts to a data collecting routine S-11 representing data collecting means.

Figure 5:
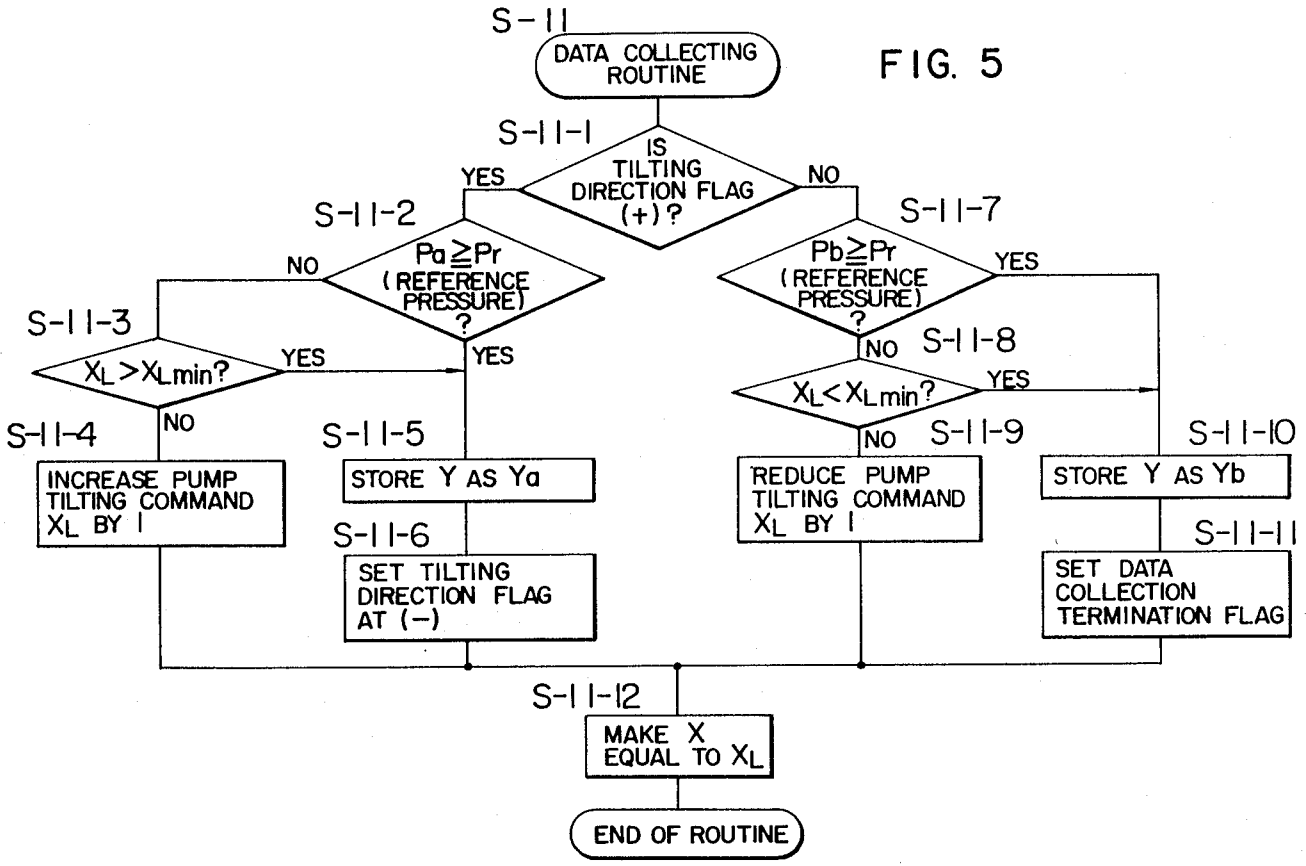

FIG. 5 shows a flow chart of the processes of operation followed in the data collecting routine. First of all, it is checked whether or not the tilting direction flag set in step S-7 is plus (+) (S-11-1). Since the tilting direction is set at plus (+) in step S-7, the pressure $P_a$ sensed by the pressure sensor 7*a* and read in the RAM 2*e* in step S-1 is retrieved and compared with the reference pressure $P_r$ in step S-11-2 which represents discharge pressure determining means. When the pressure $P_a$ is lower than the reference pressure $P_r$, it is judged in step S-11-3 which represents shifting determining means whether or not the value of the tilting command $X_L$ is greater than a predetermined maximum value of tilting $X_{Lmax}$.

The reason why such process of operation is performed in step S-11-3 will be described. The processes of operations performed in steps S-11-1, S-11-2 and S-11-3 described hereinabove and in steps S-11-4, S-11-12 and S-4 subsequently to be described are ones for increasing the value of tilting of the swash plate 1*a* from a neutral position (in which $X_L=0$) by a predetermined one unit value in the plus (+) direction, and they are continued until the pressure $P_a$ exceeds the reference pressure $P_r$. However, when the hydraulic pump 1 is out of order, the reference pressure $P_r$ may not be exceeded no matter how greatly the value of tilting $X_L$ of the swash plat 1*a* is increased, depending on the degree of failure of the pump 1. Therefore, if the maximum value $L_{Xmax}$ of tilting of the swash plate 1*a* is set beforehand and the pump 1 is regarded as having a failure so that the increase in the value of tilting may be stopped when the maximum value $X_{Lmax}$ is exceeded by the actual value of tilting, it would be possible to prevent unnecessary process of operation from being performed. The maximum value $X_{Lmax}$ is selected to be greater than the reference value of tilting $Y_{ra}$ based on which the pump 1 is determined as to whether or not it is normally functioning, as described hereinabove.

When the value of the tilting command $X_L$ is found not to exceed the maximum value $X_{Lmax}$ in step S-11-3, the value of the tilting command $X_L$ is increased by one unit value in step S-11-4 which represents pump shifting means. This one unit value is represented by one digit in microcomputer. Then, the value of the lever command signal X is rewritten to have the value of the tilting command $X_L$ which incorporates an increase of one unit value (S-11-12), and the swash plate 1*a* is driven in step S-4 to carry out the tilting command signal X. This process of operation is repeated until the pressure $P_a$ is found, in step S-11-2, to exceed the reference pressure $P_r$. If the pressure $P_a$ is found to exceed the reference pressure $P_r$ in step S-11-2, then the value obtained at that time by the displacement detector 6 or the value of tilting Y of the swash plate 1*a* is stored (recorded) as a value $Y_a$ step S-11-5 which constitutes reading and storing means, thereby terminating data collection in the plus (+) direction. Then, to obtain data in the minus (−) direction, the tilting direction flag is set at the minus (−) direction in step S-11-6 which represents reversing means. In step S-11-3, when the value of the tilting command $X_L$ is found in step S-11-3 to exceed the maximum value $X_{Lmax}$ which is greater than the reference value of tilting $Y_{ra}$ based on which it is determined whether or not the pump 1 is normally functioning, the value of such tilting command $X_L$ is stored in step S-11-5. Steps S-11-2 to S-11-5 represent plus (+) direction data collecting means. After the tilting direction flag is set at the minus (−) direction in step S-11-6, the process of operation shifts through steps S-11-12, S-4, S-1, S-2, S-5, S-6 and S-10 again to step S-11-1, in which the direction of the tilting direction indicating flag is determined.

As described hereinabove, the tilting direction flag was set at the minus (−) direction in step SK-11-6, so that the tilting of the swash plate 1*a* is increased in the plus (+) direction in the following operations. More specifically, the tilting command $X_L$ for the swash plate 1*a* is reduced stepwise by one unit value until the pressure $P_b$ sensed by the pressure sensor 7*b* reaches the reference pressure $P_r$ set beforehand, in the same manner as described hereinabove with reference to the operation performed in the plus direction. These processes of operation are performed in steps S-11-7, S-11-8 and S-11-9. In this case, since the operation relates to the minus (−) direction, a value corresponding to the maximum value $X_{Lmax}$ for tilting the swash plate 1*a* is set at a minimum value $X_{Lmin}$ which has the same absolute value as the maximum value $X_{Lmax}$ but is opposite in sign thereto. If it is found that the sensed pressure $P_b$ is higher than the reference pressure $P_r$ (S-11-7), then the value of tilting Y of the swash plate 1*a* in the minus (−) direction is stored (recorded) as a value $Y_b$ (S-11-10). The steps S-11-7 to S-11-10 represent minus (−) direction data collection means. Data collection is terminated when the values of tilting $Y_a$ and $Y_b$ of the swash plate 1*a* in the plus (+) direction and the minus (−) direction, respectively, are stored. Then, the data collection termination flag is set (S-11-11).

When the process of operation shifts to step S-10, it is determined that the data collection termination flag has been set in step S-11-11, and the process of operation shifts to a failure judging routine S-12 which represents failure judging means.

Figure 6:
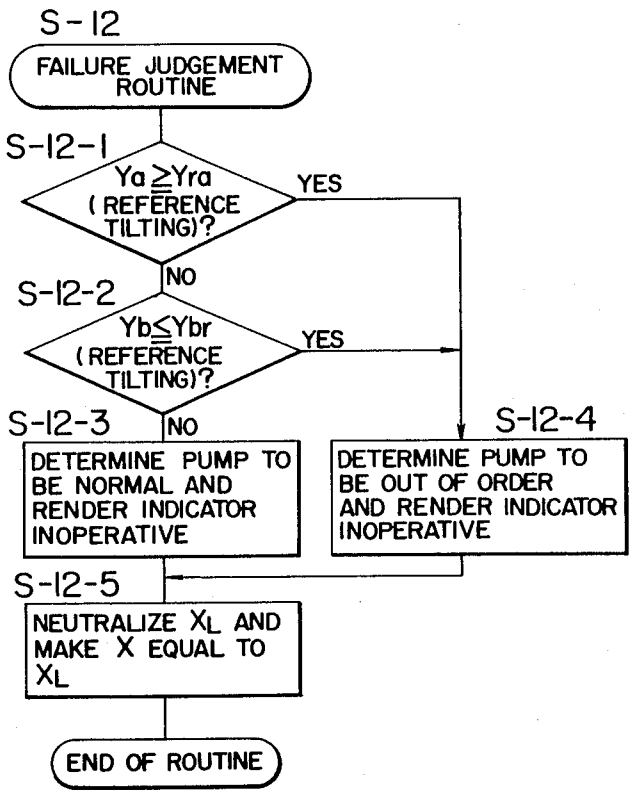
FIGS. 4, 5 and 6 are flow charts of the processes of operations for performing the swash plate tilting servo routine, data collecting routine and failure judging routine, respectively, shown in FIG. 3.
Figure 4:
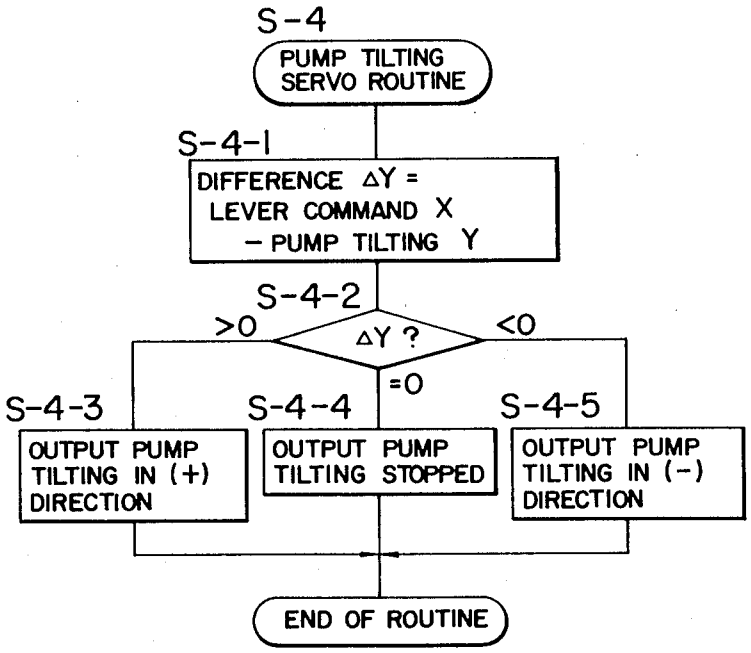

FIG. 6 shows in a flow chart the failure judging routine, in which the value of tilting $Y_a$ of the swash plate 1*a* in the plus (+) direction that has been stored is compared with the reference value $Y_{ra}$ (S-12-1). When the value of tilting $Y_a$ is smaller than the reference value $Y_{ra}$, the value of tilting $Y_b$ in the minus direction (−) that has been stored is compared with a reference value $Y_{rb}$ which has the same absolute value as the reference value $Y_{ra}$ but is opposite in sign thereto (S-12-2). When the value of tilting $Y_b$ is found to be greater than the reference value $Y_{rb}$ it is found that $Y_a < Y_{ra}$ and $Y_b > Y_{rb}$ for both steps S-12-1 and S-12-2, so that the hydraulic pump 1 is determined to be normally functioning and the indicator 10 is rendered inoperative (S-12-3). Since the value of tilting $Y_b$ of the swash plate 1*a* and the reference value $Y_{rb}$ both relate to operation in the minus (−) direction, they are negative values. Thus, when comparison is made in steps S-12-1 and S-12-2, their inequality signs are made reverse. If the value of tilting $Y_a$ of the swash plate 1*a* is found to be greater than the reference value $Y_{ra}$ in step S-12-1 or if the value of tilting $Y_b$ is found to be smaller than the reference value $Y_{rb}$ in step S-12-2, then the hydraulic pump is determined to be out of order and the indicator 10 is rendered operative (S-12-4) to indicate that pump 1 is not normally functioning. Then, the tilting command $X_L$ for tilting the swash plate 1*a* is neutralized, and the value of the lever command signal X is rewritten to have the value $X_L$ (S-12-5), so that the swash plate 1*a* is restored to its initial position in step S-4.

From the foregoing, it will be appreciated that in the embodiment of the invention shown in FIGS. 1-6 and described hereinabove, the valve 5 interposed between the hydraulic motor 4 and hydraulic pump 1 is closed and the swash plate 1*a* is gradually tilted when a command is given by the start switch 9. The values of tilting of the swash plate 1*a* are recorded both in the plus (+) and minus (−) direction when the discharge pressure of the hydraulic pump 1 reaches reference pressures set beforehand, and the values of tilting are compared with reference values set beforehand for determining whether or not the pump is normally functioning. When the pump is determined to be out of order as a result of the comparison, the indicator is rendered operative to indicate that the hydraulic pump 1 is not normally functioning. Thus, the failure detection system for a hydraulic pump according to the embodiment enables detection of a failure of the hydraulic pump to be effected automatically and quickly without the risk of foreign matter being incorporated in the hydraulic circuit by eliminating the need to cut off a hydraulic line and connect a hydraulic pressure to a tester as has hitherto been the case in the prior art. Also, the embodiment enables a multiplicity of hydraulic pumps to be checked simultaneously to determine if any one of them might have ceased to normally function. Additionally, the embodiment enables a control unit which controls the normal operation of a hydraulic pump to be used for the purpose of checking on the hydraulic failure, and therefore checking on the pump for its failure can be easily effected without using a complex mechanism, and the failure checking can be effected when the hydraulic pump is started or when its inspection is performed, so that the pump can be monitored at all times.

Figure 7:
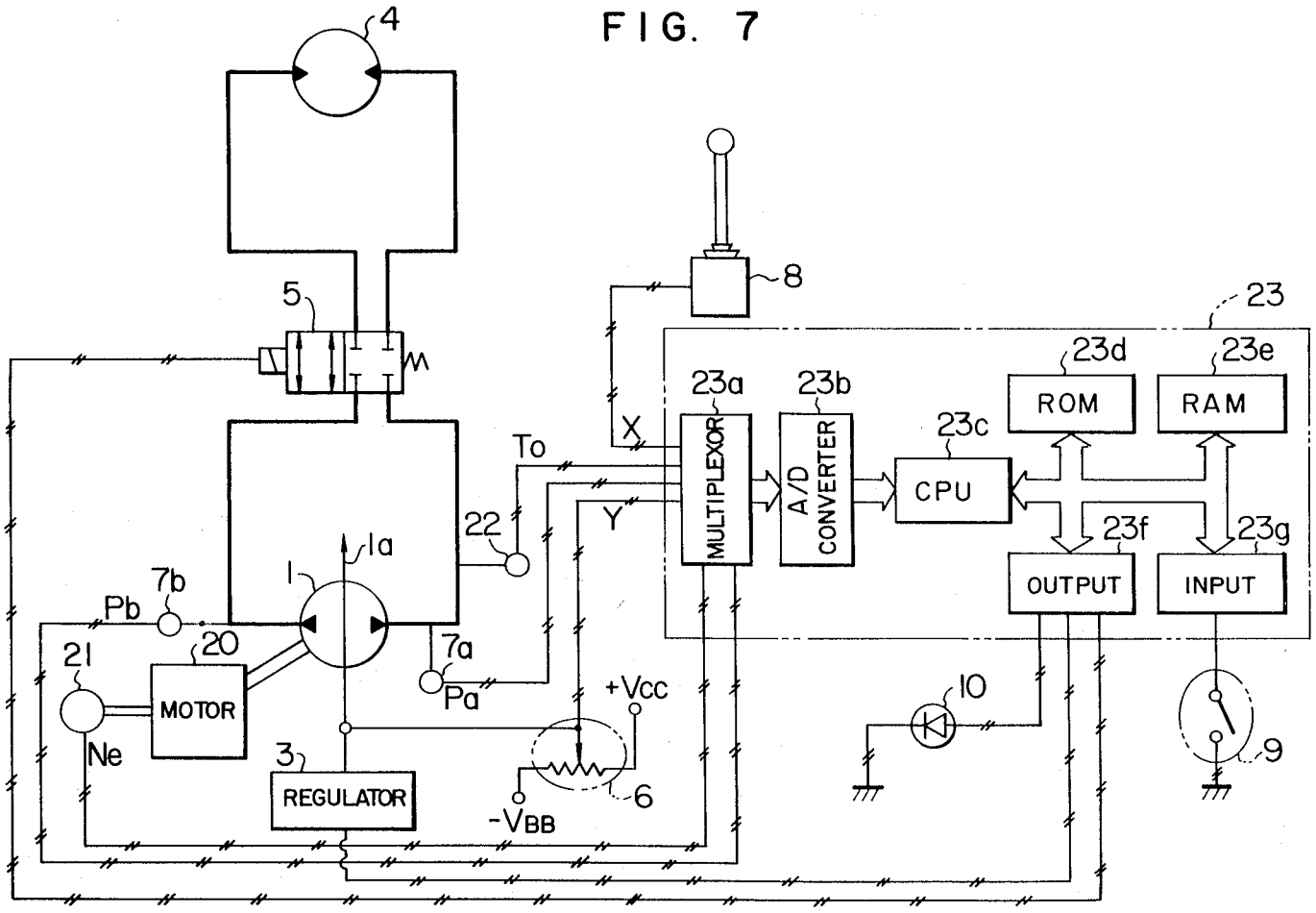
FIG. 7 is a block diagram of failure detection system for a hydraulic pump comprising a second embodiment.

FIG. 7 shows a second embodiment of the failure detection system for a hydraulic pump in conformity with the invention in which parts similar to those shown in FIG. 1 are designated by like reference characters.

In the embodiment shown in FIG. 7, the failure detection system comprises, in addition to the displacement detector 6 and pressure sensors 7*a* and 7*b*, a revolution counter 21 for counting the number of revolutions of a prime mover 20, such as an engine, for driving the hydraulic pump 1, and a temperature sensor 22 for sensing the temperature of a hydraulic fluid flowing in the hydraulic circuit constituted by the pump 1 and the motor 4.

A control unit 23 which is constituted by a microcomputer as is the case with the control unit 2 of the first embodiment comprises a multiplexor 23*a*, an A/D converter 23*b*, a central processor unit (CPU) 23*c*, a read-only memory (ROM) 23*d*, a random-access memory (RAM) 23*e*, an output section 23*f* and an input section 23*g*. The control unit 23 has inputted thereto through the multiplexor 23*a* a signal Y from the displacement detector 6, signals $P_a$ and $P_b$ from the pressure sensors 7*a* and 7*b*, a signal X from the operation lever 8, a signal $N_e$ from the revolution counter 21 and a signal $T_o$ from the temperature sensor 22, and checks on the hydraulic pump 1 to see if it is normally functioning.

Generally, an increase in the number of revolutions of a hydraulic pump results in an increase in leaks of the hydraulic fluid through sliding portions of the pump. The same phenomenon occurs when the temperature of a hydraulic fluid shows a rise. Because of this phenomenon, the values of tilting $Y_a$ and $Y_b$ of the swash plate 1*a* which produce a pressure equal to the reference pressure $P_r$ set beforehand would show changes in their absolute values. Thus, when the number of revolutions of the hydraulic pump 1 increases or when the temperature of the hydraulic fluid rises, there would be the risk that the pump 1 might be determined by mistake as being out of order. To obviate this disadvantage, in the second embodiment shown in FIG. 7, signals produced by the revolution counter 21 and temperature sensor 22 are inputted to the control unit 23 to compensate the reference values $Y_{ra}$ and $Y_{rb}$ for failure determination for an increase in the number of revolutions and a rise in temperature. However, it is not essential to use the signals of both the revolution counter 21 and temperature sensor 22, and a signal produced by either one of counter 21 and sensor 22 may be used. To effect compensation, any one of processes may be used. One of them consists in storing in the memory values of a predetermined functional relation as values based on which the hydraulic pump is determined as to whether or not it is normally functioning, and inputting a signal or signals from the revolution counter and/or temperature sensor to the control unit to directly obtain the reference values $Y_a$ and $Y_b$ to determine whether or not the pump is normally functioning. Another process consists in correcting the reference values $Y_a$ and $Y_b$ for determining whether or not the pump is normally operating by adding thereto a value associated with the signals from the revolution counter and/or temperature sensor.

Figure 3:
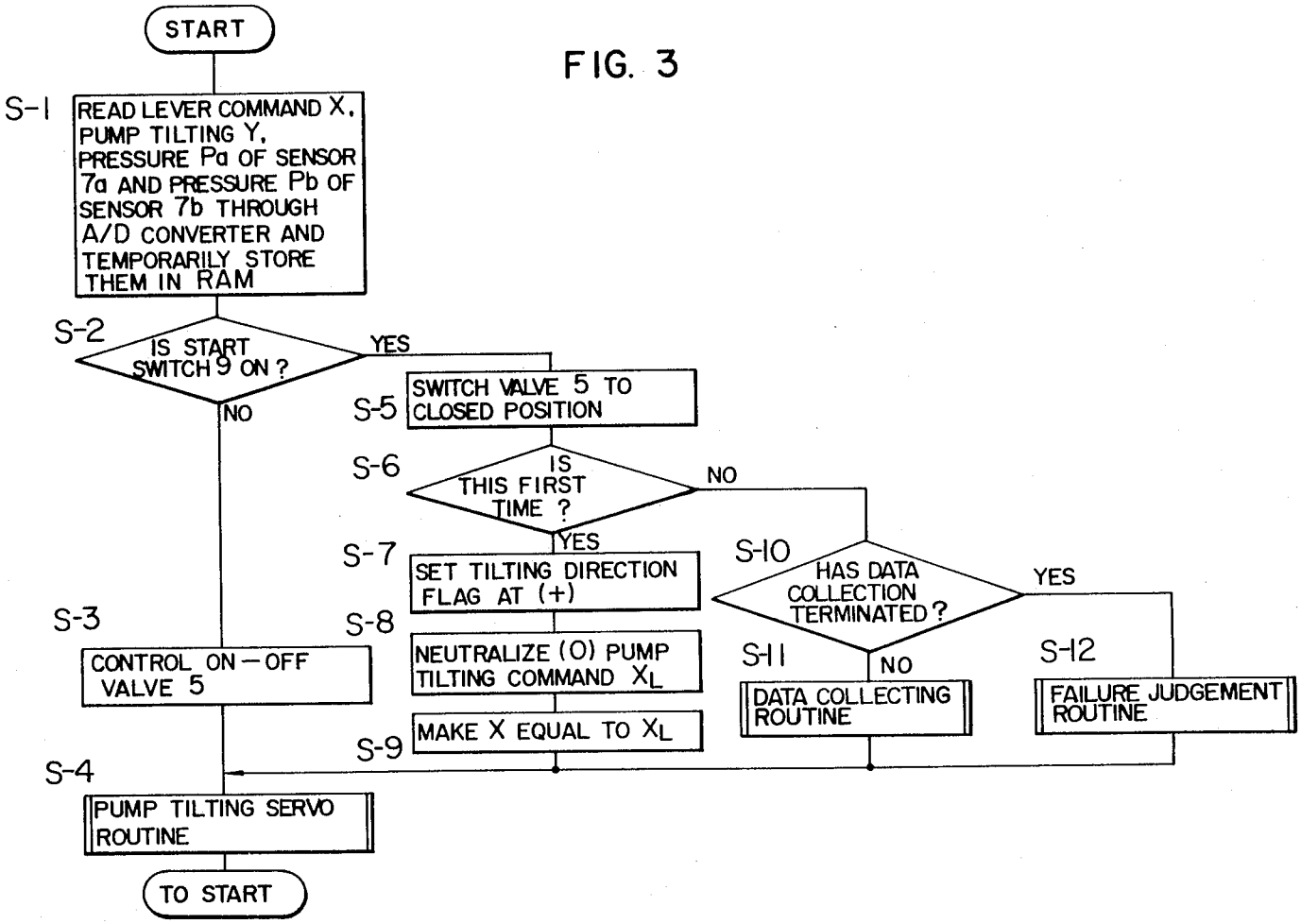
FIG. 3 is a flow chart of the process of operation stored in the read-only memory of the control unit shown in FIG. 1.
Figure 8:
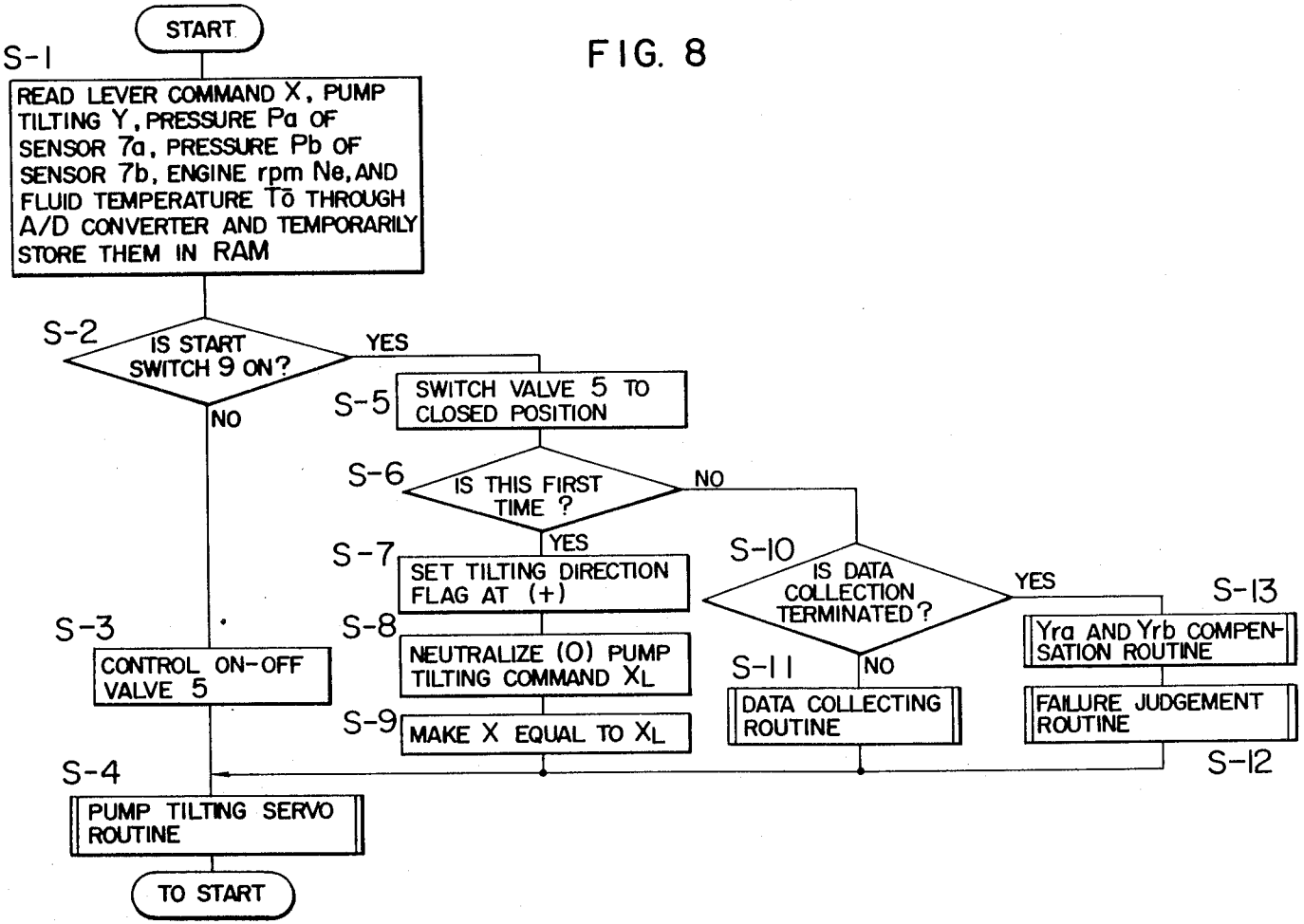
FIG. 8 is a flow chart of the process of operation stored in the read-only memory of the control unit shown in FIG. 7.

FIG. 8 shows a flow chart of the processes of operation stored in the ROM 23*d* of the control unit 23 which is performed by using values of a predetermined functional relation as the reference values $Y_{ra}$ and $Y_{rb}$ for determining whether the hydraulic pump 1 is normally functioning. The flow chart shown in FIG. 8 is similar to the flow chart shown in FIG. 3 except that the step S-1 shown in FIG. 3 is replaced by a step S-1′, and that a step S-13 which represents first means for compensation based on fluid temperature and second means for compensation based on the number of revolutions is additionally provided. That is, the flow chart shown in FIG. 8 shares the steps S-2 to S-12 with the flow chart shown in FIG. 3.

In FIG. 8, the number of revolutions $N_e$ of the engine and the temperature $T_{\bar{o}}$ of the hydraulic fluid are additionally read out of the A/D converter $23_b$ and temporarily stored in the RAM 23*e* in step S-1′.

In step S-13, a compensation routine is followed in which the reference values $Y_{ra}$ and $Y_{rb}$ used in step S-12 for determining whether or not the pump 1 is normally functioning are compensated by the number of revolutions $N_e$ of the engine and the temperature $T_{\bar{o}}$ of the hydraulic fluid read in step S-1′. The process of operation performed in the compensation routine will be described in detail by referring to FIG. 9.

Figure 9:
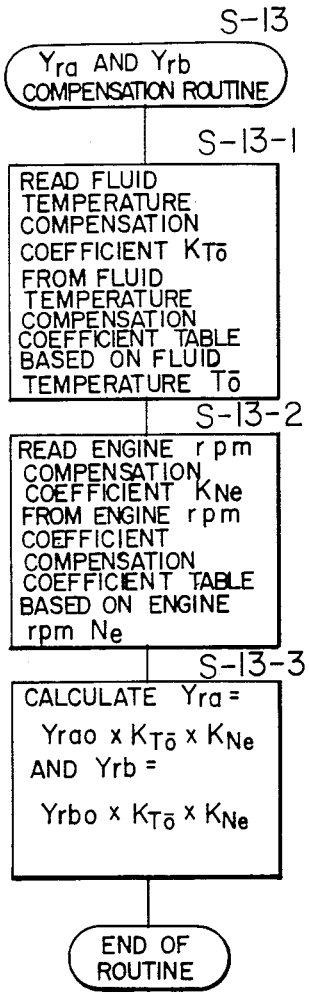
FIG. 9 is a flow chart of the process of operation of the compensation routine shown in FIG. 8.
Figure 10:
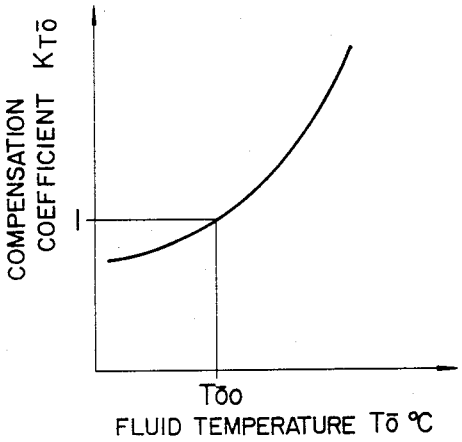
FIGS. 10 and 11 show the hydraulic fluid temperature compensation coefficient table and engine rpm. compensation coefficient table, respectively, used in the process of operation shown in FIG. 9.

Referring to FIG. 9, in step S-13-1, a compensation coefficient $K_{T\bar{o}}$ is read out of the fluid temperature compensation coefficient table shown in FIG. 10 in accordance with the fluid temperature $T_{\bar{o}}$. In step S-13-2, a compensation coefficient $K_{Ne}$ is read out of the engine number of revolutions compensation coefficient table shown in FIG. 11.

Figure 11:
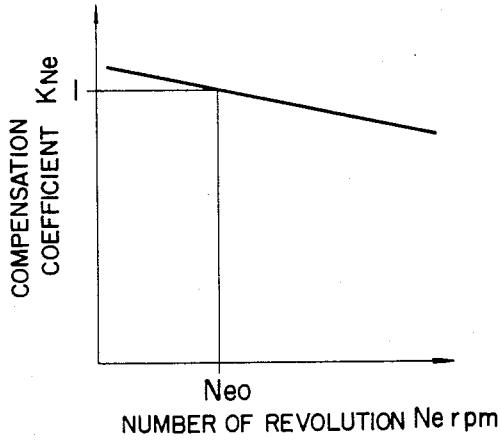

The compensation coefficient tables shown in FIGS. 10 and 11 are stored in the ROM 23*d* beforehand.

In step S-13-3, reference values $Y_{ra}$ and $Y_{rb}$ are obtained by doing calculation on initially set values $Y_{rao}$ and $Y_{bro}$ for the reference values $Y_{ra}$ and $Y_{rb}$, respectively, by the following equations:

$$Y_{ra}=Y_{rao}\times K_{T\bar{o}}\times K_{Ne} \quad (1)$$

$$Y_{rb}=Y_{rbo}\times K_{T\bar{o}}\times K_{Ne} \quad (2)$$

$Y_{rao}$ and $Y_{bro}$ are the values of $Y_{ra}$ and $Y_{rb}$ which are obtained based on $T_{\bar{o}o}$ and $N_{eo}$ when the coefficients $K_{T\bar{o}}$ and $K_{Ne}$ become "1" in the tables shown in FIGS. 10 and 11, respectively. The values of $Y_{rao}$ and $Y_{bro}$ are stored in the ROM 23*d*. beforehand.

The compensation coefficient tables shown in FIGS. 10 and 11 will be described. FIGS. 10 and 11 show one example of tables of compensation coefficients $K_{T\bar{o}}$ and $K_{Ne}$ with respect to the fluid temperature $T_{\bar{o}}$ and the number of revolutions $N_e$ of the engine, respectively.

Generally, the viscosity of a hydraulic fluid becomes lower as an exponential function of a rise in its temperature, and a leak of the fluid is in inverse proportion to its viscosity. $Y_{ra}$ and $Y_{rb}$ represent tilting positions in which the pump 1 produces a discharge corresponding to the leak. Thus, the table of $T_{\bar{o}}$ and $K_{T\bar{o}}$ is generally in the form as shown in FIG. 10. Meanwhile, leaks through valve plate surfaces of a hydraulic pump become greater in volume in proportion to the difference in velocity between the two surfaces or the number of revolutions, while the discharge of the pump at the same tilting angle becomes greater in volume in proportion to the number of revolutions. The discharge is remarkably greater than the leak, so that the influence exerted by the leak is considered to be small. Thus, the table of $N_e$ and $K_{Ne}$ is generally in the form shown in FIG. 11. However, the tables shown in FIGS. 10 and 11 may vary depending on the type of the hydraulic pump 1 because these characteristics will vary depending on the type of the pump.

By effecting compensation of the reference values $Y_{ra}$ and $Y_{rb}$ for determining whether the pump 1 is normally functioning in the compensation routine, judgement in step S-12 is made by using the compensated reference values $Y_{ra}$ and $Y_{rb}$ and by following the processes of operation shown in FIG. 6.

In the flow chart shown in FIG. 9, the reference values $Y_{ra}$ and $Y_{rb}$ are compensated for both the increase in the number of revolutions of the engine and the rise in the temperature of the hydraulic fluid. However, this is not restrictive, and the reference values $Y_{ra}$ and $Y_{rb}$ may be compensated for one of the increase in the number of revolutions and the rise in the temperature of the hydraulic fluid.

From the foregoing, it will be appreciated that in the embodiment shown and described hereinabove, the reference values based on which the pump 1 is determined as to whether or not it is normally functioning are compensated for an increase in the number of revolutions of the engine and/or a rise in the temperature of the hydraulic fluid, in addition to the operations being performed in the embodiment shown in FIGS. 1–6. As a result, the second embodiment enables the failure of a hydraulic pump to be checked with a higher degree of accuracy than the first embodiment.

Figure 12:
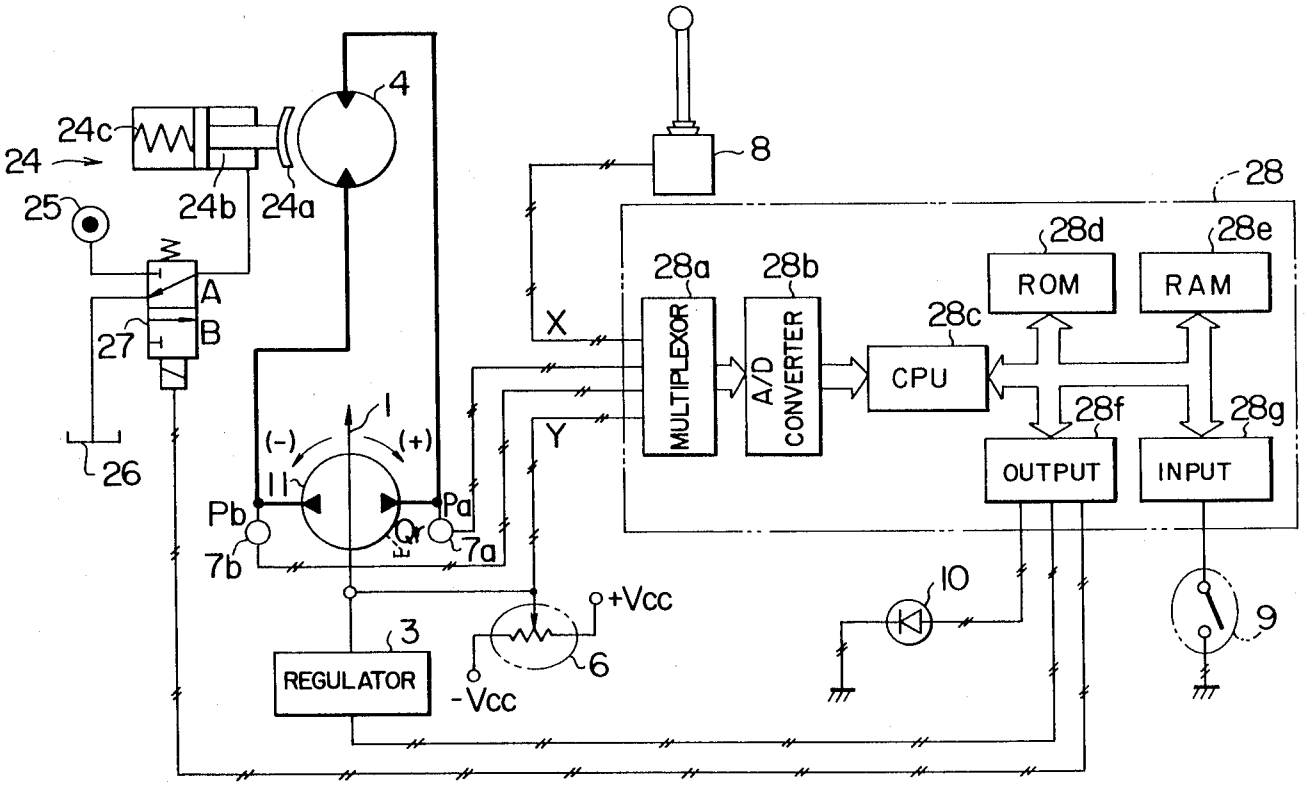
FIG. 12 is a block diagram of the failure detection system for a hydraulic pump comprising a third embodiment.

FIG. 12 shows a third embodiment of the failure detection system for a hydraulic pump in conformity with the invention in which parts similar to those shown in FIG. 1 are designated by like reference characters.

In the third embodiment shown in FIG. 12, the control valve 5 shown in FIG. 1 is replaced by brake means 24 for keeping the hydraulic motor 4 in an inoperative condition as means for closing the hydraulic circuit to block the flow of the hydraulic fluid therethrough.

The brake means 24 comprises a brake show 24*a*, a cylinder chamber 24*b* and a spring 24*c*. The spring 24*c* is contracted by a hydraulic fluid fed into the cylinder chamber 24*b* from a hydraulic fluid source 25 to thereby release the brake shoe 24*a* from engagement with the hydraulic motor 4. When the cylinder chamber 24*b* is brought into communication with a reservoir 26, the spring 24*c* is expanded and the brake shoe 24*a* is brought into engagement with the hydraulic motor 4 to thereby apply a brake. A change-over valve 27 for the brake means 24 is operative to control communication between the cylinder chamber 24*b* of the brake means 24 and the hydraulic fluid source 25 and reservoir 26 by an electric signal from a control unit 28. When no electric signal is produced by the control unit 28, the change-over valve 27 shifts to an A position in which it allows the cylinder chamber 24*b* to communicate with the reservoir 26 to actuate the brake means 24; when an electric signal is produced by the control unit 28, the change-over valve 27 shifts to a B position in which it brings the cylinder chamber 24*b* into communication with the hydraulic fluid source 25 to release the brake means 24 from the brake applying position.

Like the control unit 2 shown in FIG. 1, the control unit 28 is operative to receive a signal Y from the displacement detector 6, signals $P_a$ and $P_b$ from the pressure sensors 7*a* and 7*b* and a signal X from the operation lever 8 and check on the hydraulic pump 1 to see if it is normally functioning based on these signals, and the control unit 28 comprises a multiplexor 28*a*, an A/D converter 28*b*, a CPU 28*c*, a ROM 28*d*, a RAM 28*e*, an output section 28*f* and an input section 28*g*.

Figure 13:
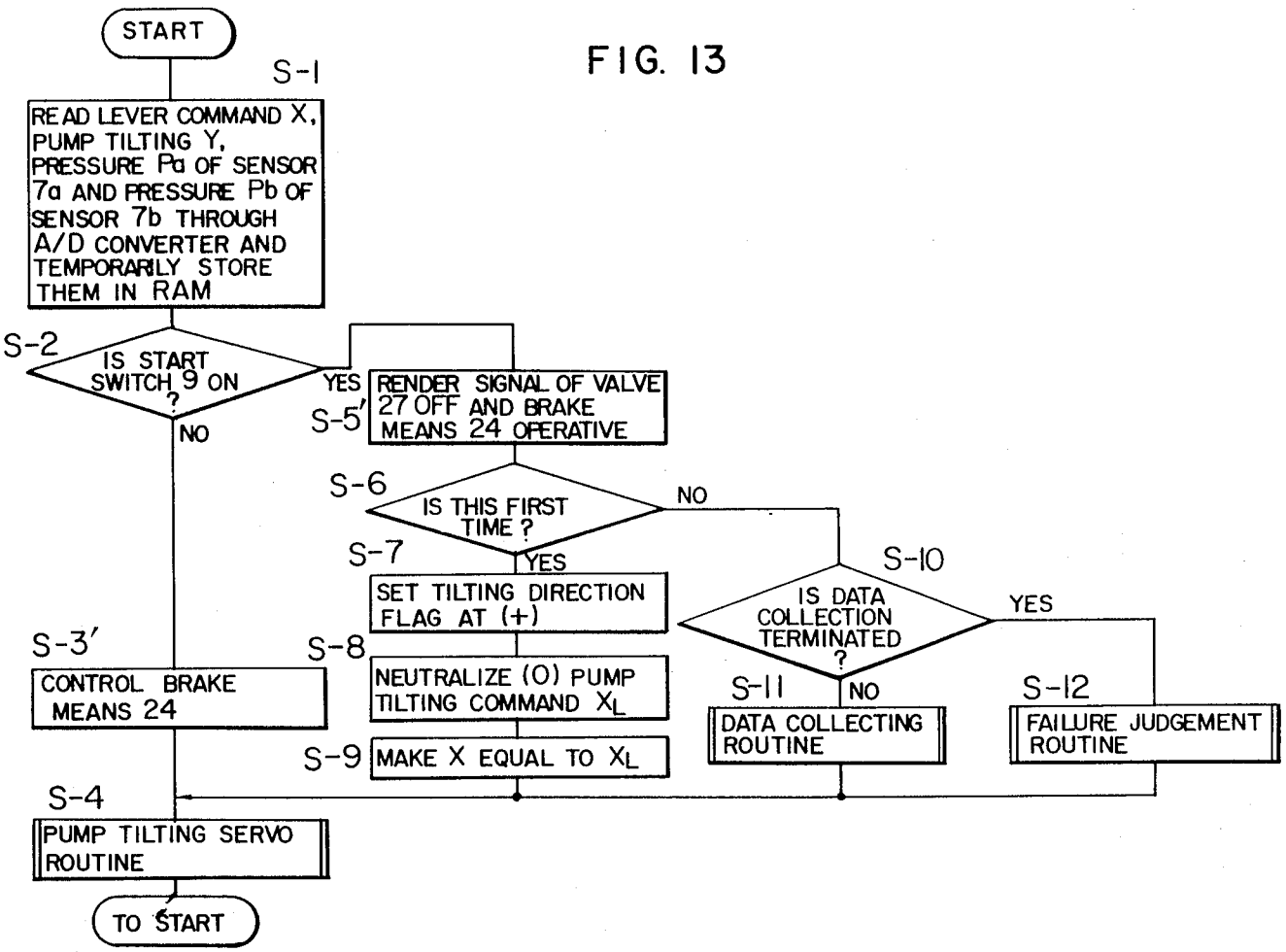
FIG. 13 is a flow chart of the process of operation stored in the read-only memory of the control unit shown in FIG. 12.

FIG. 13 shows a flow chart of the processes of operation stored in the ROM 28*d* of the control unit 28. The flow chart shown in FIG. 13 is distinct from the flow chart shown in FIG. 3 in that the steps S-3 and S-5 of the latter are replaced by steps S-3′ and S-5′. In other steps, there are no differences between the two flow charts.

In step S-3′, when the hydraulic motor 4 connected to the hydraulic pump 1 is to be driven, an ON signal for moving the change-over valve 27 to the B position to release the brake means 24 from the brake applying position is outputted through the output section 28*f* to the change-over valve 27, and when the hydraulic motor 4 is to be rendered inoperative, an OFF signal for moving the change-over valve 27 to the A position to bring the brake means 24 to the brake applying position is outputted through the output section 28*f* to the change-over valve 27.

In step S-5′, an OFF signal for moving the change-over valve 27 to the A position to bring the brake means 24 to the brake applying position is outputted to the valve 27.

It will be apparent that by using the brake means 24 as means for closing the hydraulic circuit to block the flow of the hydraulic fluid therethrough, the embodiment shown in FIG. 7 is capable of achieving the same effects as the embodiment shown in FIG. 1.

Figure 2:
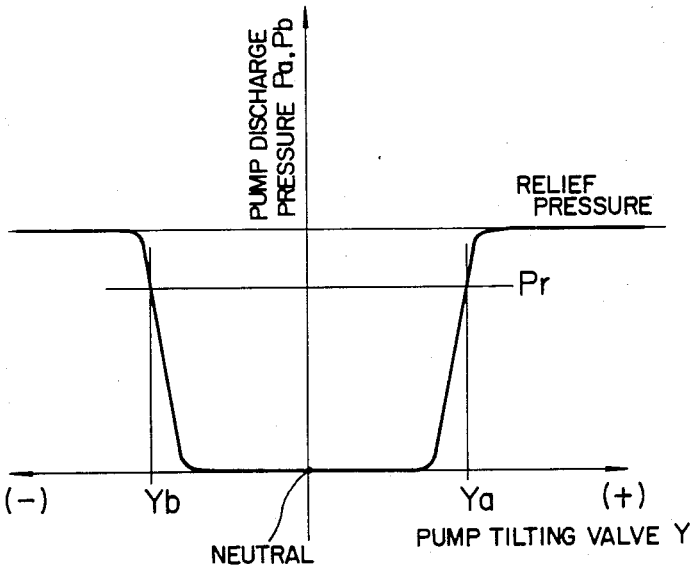
FIG. 2 is a diagrammatic representation of the relation between the tilting of the swash plate of the hydraulic pump and the discharge pressure of the hydraulic pump, in explanation of the principle of operation of the failure detection system according to the invention.
Figure 14:
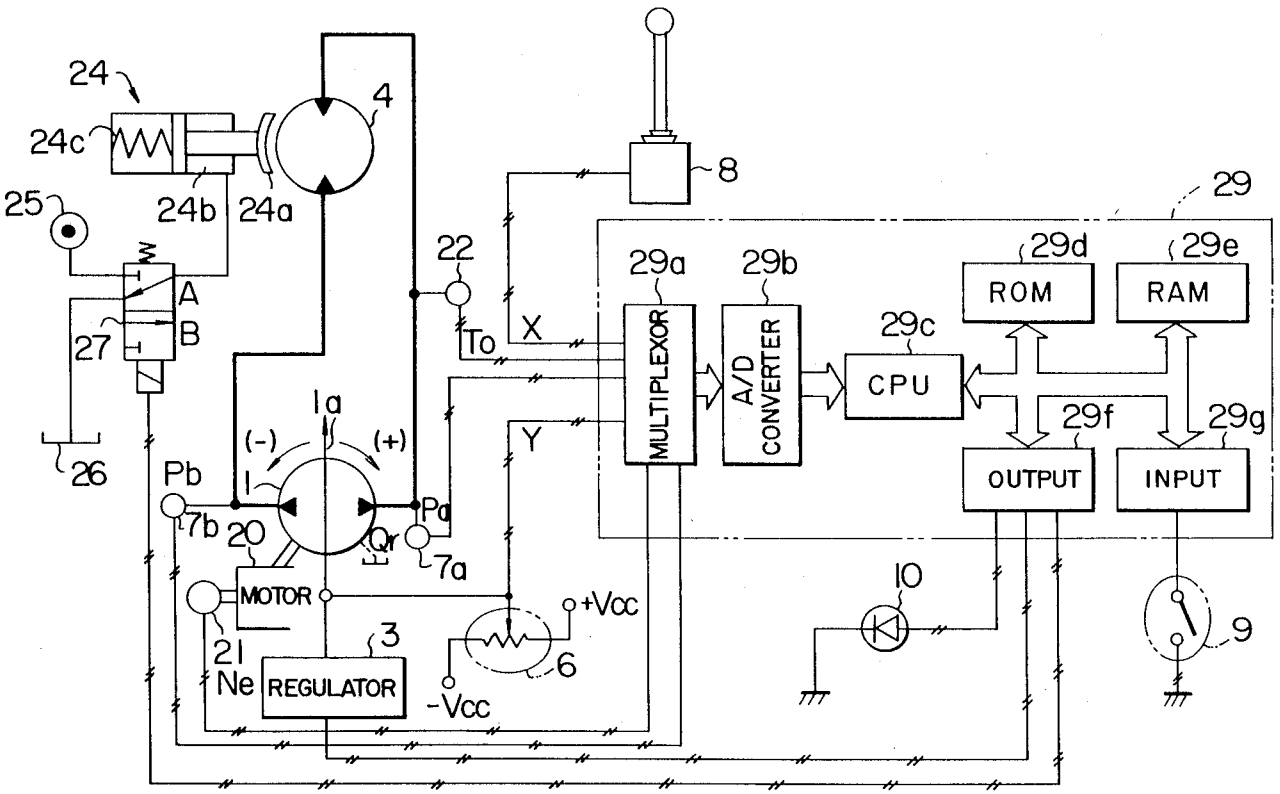
FIG. 14 is a block diagram of the failure detection system for a hydraulic pump comprising a fourth embodiment.
Figure 15:
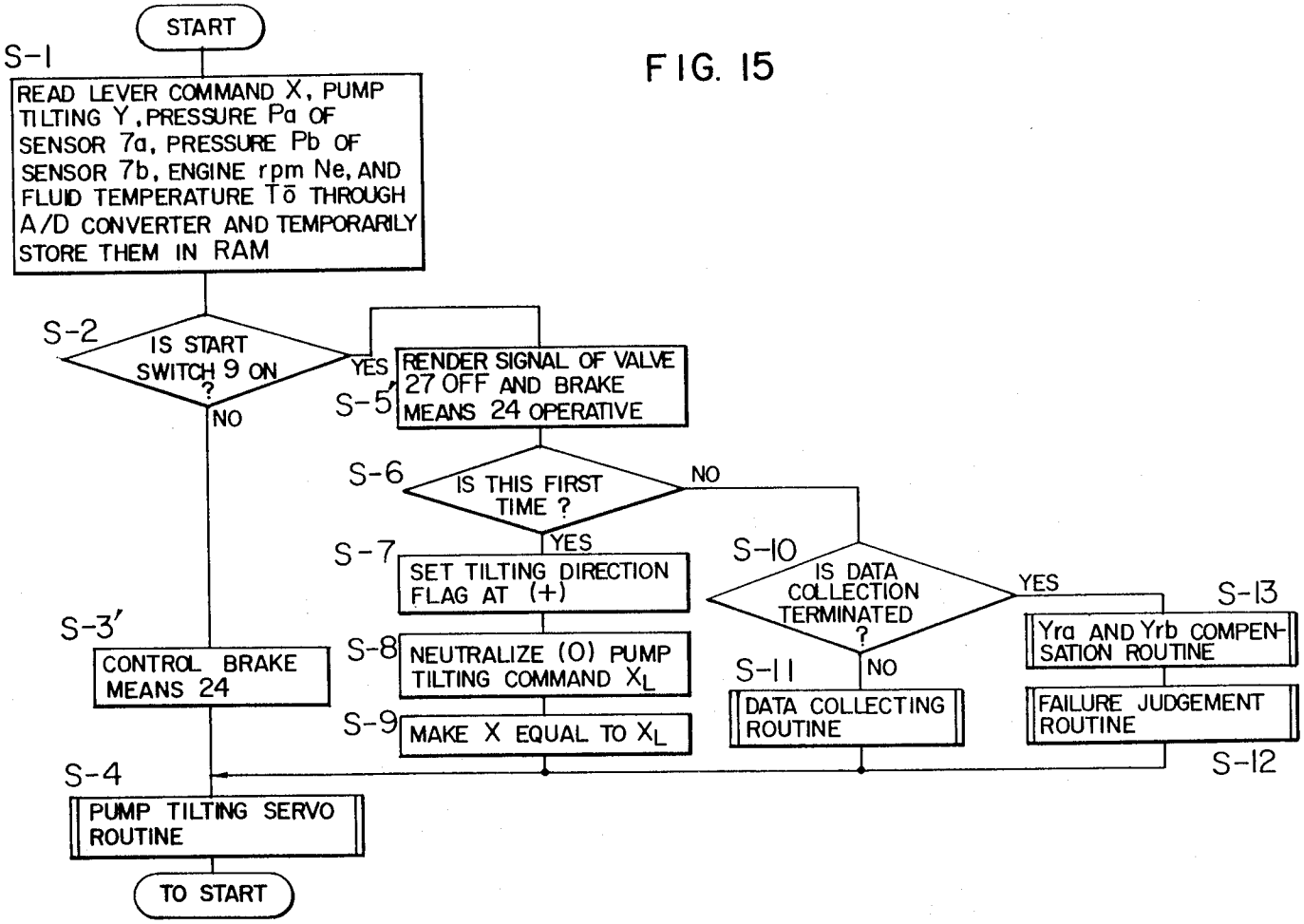
FIG. 15 is a flow chart of the process of operation stored in the read-only memory of the control unit shown in FIG. 14.

FIG. 14 shows a fourth embodiment of the failure detection system for a hydraulic pump in conformity with the invention in which parts similar to those shown in FIGS. 1–3 are designated by like reference characters. This embodiment incorporates therein the modifications provided by both the embodiments shown in FIGS. 7 and 12 to the embodiment shown in FIG. 1. More specifically, the system comprises the revolution counter 21, temperature sensor 22 and brake means 24 referred to hereinabove. The processes of operation stored in a ROM 29*d* of a control unit 29 of the system correspond, as shown in FIG. 15, to one which is obtained by replacing the steps S-1, S-3 and S-5 of the flow chart shown in FIG. 3 by the steps S-1′, S-3′ and S-5′, respectively, which have been described hereinabove.

It will be apparent that the fourth embodiment shown in FIG. 14 is capable of increasing the accuracy and precision with which detection of failure of a hydraulic pump is performed, as is the case with the second embodiment shown in FIG. 7.

In the embodiments shown and described hereinabove, the hydraulic pump has been checked to see if it is normally functioning by comparing the values of tilting of the swash plate under the reference pressures in both the plus (+) and minus (−) directions with the reference values based on which the hydraulic pump is judged as to whether or ot it is normally functioning. However, this is not restrictive and failure of the hydraulic pump can be checked by the system according to the invention by using the value of tilting of the swash plate in one direction only. Also, in the embodiments shown and described hereinabove, the indicator is actuated when the hydraulic pump is found to be out of order. To this end, various types of indicator other than the light-emitting diode may be used, and also it is not essential to use a visual indicator, and an alarm system or means for interrupting the operation of the prime mover may be used. Thus, a signal produced when the pump is found to be out of order may be utilized in various different forms. The start switch for determining whether or not the hydraulic pump should be checked to see if it is normally functioning may be either manually or automatically actuated. When it is automatically actuated, it may be in the form of a switch which is closed in conjunction with other operation such as the operation of starting the prime mover for driving the hydraulic pump and opened after lapse of a predetermined period of time. Also, the start switch may of a type in which the pump is checked when the switch is opened, not when it is closed.

From the foregoing, it will be appreciated that in the failure detection system for a hydraulic pump according to the invention, the value of shifting of the displacement volume varying means of the hydraulic pump is increased while actuating the means for closing the hydraulic circuit to block the flow of a hydraulic fluid therethrough; the value of shifting of the displacement volume varying means obtained when the discharge pressure of the hydraulic pump has reached a reference pressure is compared with a reference value for judging failure of the pump; and a signal is produced to indicate that the hydraulic pump is not nromally functioning when the value of shifting of the displacement volume varying means becomes at least substantially equal to the reference value. Thus, the need to connect a hydraulic pressure tester by cutting off a hydraulic line as is done in the prior art is eliminated, and the hydraulic pump can be checked automatically and quickly at all times without the risk of foreign matter, such as dust, being incorporated in the hydraulic fluid flowing in the hydraulic circuit. The invention also enables a multiplicity of hydraulic pumps to be checked simultaneously so as to detect any pump that might have a failure.

What is claimed is:

1. A failure detection system for a hydraulic pump having displacement volume varying means and connected to at least one hydraulic actuator to constitute a hydraulic circuit for driving said hydraulic actuator, such failure detection system comprising:

(a) means for sensing the discharge pressure of said hydraulic pump;

(b) means for detecting the value of shifting of said displacement volume varying means;

(c) means for closing said hydraulic circuit to block the flow of a hydraulic fluid through the hydraulic circuit;

(d) starting means for giving a command to start checking on the hydraulic pump to see if it is normally functioning;

(e) control means for performing checking on the hydraulic pump to see if it is normally functioning;

(f) said control means including: (i) means responsive to the command given by said starting means for giving a command to activate said closing means; (ii) data collecting means for causing said displacement volume varying means to shift based on information supplied by said pressure sensing means and shifting detecting means until the discharge pressure of the hydraulic pump becomes at least substantially equal to a predetermined reference pressure to collect data on the value of the shifting of said displacement volume varying means when the discharge pressure becomes substantially equal to the reference pressure; and (iii) failure judging means for comparing the value collected by said data collecting means with a predetermined reference value of shifting to produce a failure signal when the collected value is greater than the reference value; and (g) indication means responsive to said failure signal produced by said failure judging means for indicating that the hydraulic pump is not normally functioning.

2. A failure detection system as claimed in claim 1, wherein said data collecting means includes means for determining whether or not the discharge pressure of said hydraulic pump is higher than the reference pressure, means for shifting said displacement volume varying means by a predetermined unit value when the discharge pressure is not higher than the reference pressure, and means for reading and storing the value of shifting of said displacement volume varying means when the discharge pressure becomes substantially equal to the reference pressure.

3. A failure detection system as claimed in claim 2, wherein said data collecting means further includes means for determining, before said pump shifting means is operated, whether or not a command value for the shifting of the displacement volume varying means is greater than a predetermined maximum value so as to allow said pump shifting means to be operated when the command value is smaller than the maximum value and allow said reading and storing means to be operated to read and store the value of shifting of the displacement volume varying means when the command value becomes substantially equal to the maximum value.

4. A failure detection system as claimed in claim 1, wherein said control means further includes (iv) pump control means responsive to the command given by said starting means to set, before said data collecting means and failure judging means are operated, the shifting of said displacement volume varying means at zero.

5. A failure detection system as claimed in claim 1, wherein said displacement volume varying means of said hydraulic pump is capable of shifting both in a plus (+) direction and a minus (−) direction, and wherein said control means further includes (v) initial shifting direction deciding means operative to decide, before said data collecting means and failure judging means are operated, an initial shifting direction of said displacement volume varying means to be used when the data collecting means is operated.

6. A failure detection system as claimed in claim 5, wherein said data collecting means includes means for collecting data when the displacement volume varying means shifts in the plus (+) direction, means for collecting data when the displacement volume varying means shifts in the minus (−) direction, and means for reversing the direction of shifting of said displacement volume varying means, after the displacement volume varying means is caused to shift in the initial direction decided by said initial shifting direction deciding means and data is collected by one of said plus (+) direction data collecting means and minus (−) direction data collecting means, so as to collect data by the other data collecting means.

7. A failure detection system as claimed in claim 1, further comprising (h) means for sensing the temperature of a hydraulic fluid flowing through said hydraulic pump, and wherein said control means further includes (vi) first means for compensating said reference value of shifting for a variation in the temperature of the hydraulic fluid.

8. A failure detection system as claimed in claim 1, further comprising (i) means for counting the number of revolutions of said hydraulic pump, and wherein said control means further includes (vii) second means for compensating the reference value of shifting for a variation in the number of revolutions of the hydraulic pump.

9. A failure detection system as claimed in claim 1, wherein said closing means includes an on-off valve connected to said hydraulic circuit between the hydraulic pump and the hydraulic actuator.

10. A failure detection system as claimed in claim 1, wherein said closing means includes brake means for rendering the hydraulic actuator inoperative.

* * * * *